US005308377A

United States Patent [19]

Bönnemann et al.

[11] Patent Number: 5,308,377

[45] Date of Patent: May 3, 1994

[54] PROCESS FOR PREPARING MICROCRYSTALLINE-TO-AMORPHOUS METAL AND/OR ALLOY POWDERS AND METALS AND/OR ALLOYS DISSOLVED WITHOUT PROTECTIVE COLLOID IN ORGANIC SOLVENTS

[75] Inventors: Helmut Bönnemann; Werner Brijoux; Thomas Joussen, all of Mülheim, Fed. Rep. of Germany

[73] Assignee: Studiengesellschaft Kohle MbH, Mulheim, Fed. Rep. of Germany

[21] Appl. No.: 595,345

[22] Filed: Oct. 10, 1990

[30] Foreign Application Priority Data

Oct. 14, 1989 [DE] Fed. Rep. of Germany ..... 3934351

[51] Int. Cl.[5] ..... B22F 9/00

[52] U.S. Cl. ..... 75/351

[58] Field of Search ..... 75/351

[56] References Cited

U.S. PATENT DOCUMENTS 3,672.867 6/1972 Little ..... 75/5 AA
4,096,316 6/1978 Tamai et al. ..... 428/457
4,863,510 9/1990 Tamemasa et al. ..... 75/351

FOREIGN PATENT DOCUMENTS 0154534 9/1985 European Pat. Off. ..... B22F 3/00
2011936 10/1970 Fed. Rep. of Germany .
3513132 10/1986 Fed. Rep. of Germany .
1075601 3/1989 Japan ..... 75/351
9011858 10/1990 PCT Int'l Appl. ..... 75/351
1047933 11/1966 United Kingdom .

*Primary Examiner*—Upendra Roy
*Attorney, Agent, or Firm*—Sprung Horn Kramer & Woods

[57] ABSTRACT

The invention relates to a process for the preparation of finely divided microcrystalline-to-amorphous metal and/or alloy powders and of metals and/or alloys in the form of colloidal solutions in organic solvents, which is process is characterized in that in inert organic solvents metal salts individually or in admixture are reacted with alkaline metal or alkaline earth metal hydrides which are maintained in solution by means of organoboron or organogallium complexing agents, or with tetraalkylammonium triorgano-borohydrate, respectively.

11 Claims, 5 Drawing Sheets

PROCESS FOR PREPARING MICROCRYSTALLINE-TO-AMORPHOUS METAL AND/OR ALLOY POWDERS AND METALS AND/OR ALLOYS DISSOLVED WITHOUT PROTECTIVE COLLOID IN ORGANIC SOLVENTS

BACKGROUND OF THE INVENTION

The present invention relates to a process for the preparation of finely divided microcrystalline-to-amorphous metal and/or alloy powders or highly dispersed colloids by the reduction of metal salts with alkali metal or alkaline earth metal hydroxides that are kept in solution in organic solvents by means of specific complex-forming agents. What is further claimed is the use of the powders produced according to the invention in powder technology (Ullmanns Encykl. Techn. Chemie, 4th Edition, Vol. 19, p. 563) or as catalysts in a neat or supported form (Ullmanns Encykl. Techn. Chemie, 4th Edition, Vol. 13, p. 517; further: Kirk-Othmer, Encyclopedia of Chemical Technology, Vol. 19G, pp. 28 et seq.). The colloids prepared according to the invention may be used to apply the metals in the form of fine cluster particles onto surfaces (J. S. Bradley, E. Hill, M. E. Leonowicz, H. J Witzke, J. Mol. Catal. 1987, 41, 59 and literature quoted therein) or als homogeneous catalysts (J. P. Picard, J. Dunogues, A. Elyusufi, Synth. Commun. 1984, 14, 95; F. Freeman, J. C. Kappos, J. Am. Chem. Soc. 1985, 107, 6628; W. F. Maier, S. J. Chettle, R. S. Rai, G. Thomas, J. Am. Chem. Soc. 1986, 108, 2608; P. L. Burk, R. L. Pruett, K. K. Campo, J. Mol. Catal. 1985, 33, 1).

More recent methods for the preparation of superfine metal particles consist of metal evaporation (S. C. Davis and K. J. Klabunde, Chem. Rev. 1982, 82, 153–208), electrolytical procedures (N. Ibl, Chem. Ing.-Techn. 1964, 36, 601–609) and the reduction of metal halides with alkali metals (R. D. Rieke, Organometallics 1983, 2, 377) or anthracene-activated magnesium (DE 35 41 633). Further known is the reduction of metal salts with alkali metal borohydrides in an aqueous phase to form metal borides (N. N. Greenwood, A. Earnshaw, Chemistry of the Elements, Pergamon Press 1986, p. 190). The coreduction of iron and cobalt salts in water results in the production of a Fe/Co/B alloy having the composition of $Fe_{44}Co_{19}B_{37}$ (J. v. Wonterghem, St. Morup, C. J. W. Koch, St, W. Charles, St. Wells, Nature 1986, 322, 622).

SUMMARY OF THE INVENTION

It was now surprisingly found that metal hydrides of the first or second main groups of the Periodic Table can be employed as reducing agents for metal salts by means of organoboron and/or organogallium complexing agents in an organic phase, whereby metals or metall alloys in powder or colloidal form are obtained which are boride-free and/or gallium-free, respectively.

The advantages of the process according to the invention are constituted by that the reduction process can be very out under very mild conditions (−30° C. to 150° C.) in organic solvents, further by the good separability of the metal or alloy powders from the usually soluble by-products, and by the microcrystallinity of the powder and the fact that the particle size distribution may be controlled as dependent on the reaction temperature. It is a further advantage that colloidal solutions of metals or alloys are obtained under certain conditions (use of donor-metal salt complexes and/or ammoniumtriorgano hydroborates) in ethers or even neat hydrocarbons without an addition of further protective colloids.

PREFERRED EMBODIMENTS

As the metals of the metal salts there are preferably used the elements of the Groups IVA, IB, IIB, VB, VIB, VIIB and VIIIB of the Periodic Table. Examples of metals of said Groups of the Periodic Tables comprise Sn, Cu, Ag. Au, Zn, Cd, Hg, Ta, Cr, Mn, Re, Fe, Ru, Os, Co, Rh, Ir, Ni, Pd, Pt.

As the metal salts or compounds there are used those which contain either inorganic or organic anions, and preferably those which are solvated in the systems employed as solvents, such as hydroxides, oxides, halides, cyanides, cyanates, thiocyanates as well as alcoholates and salts of organic acids. As the reducing agents there are used metal hydrides of the general formula $MH_x$ ($x=1, 2$) of the first and/or second Groups of the Periodic Table which have been reacted with a complexing agent having a general formula $BR_3$, $BR_n(OR')_{3-n}$ or $GaR_3$, $GaR_n(OR')_{3-n}$, respectively (R, R'=$C_1$–$C_6$-alkyl, phenyl, aralkyl; n=0, 1, 2) {R. Köster in: Methoden der Organischen Chemie (Houben-Weyl-Müller), 4th Edition, Vol. XIII/3b, pp. 798 et seq., Thieme, Stuttgart 1983}. All types of organic solvents are suitable for the process according to the invention as far as they do not react themselves with metal hydrides, e.g. ethers, aliphatics, aromatics as well as mixtures of various solvents. The reaction of the metal hydrides with complexing agents for the purpose of solvation in organic solvents may be carried out according to the invention with particular advantage in situ, optionally with the use of a less than stoichiometric amount of complexing agent.

During the reaction of the metal salts, the complexed hydrides are converted into salts of the type $M(anion)_x$ (M=cation of ammonium, an alkali metal or an alkaline earth metal; $x=1, 2$). M-hydroxides, -alcoholates, -cyanides, -cyanates and -thiocyanates will form soluble -ate complexes with the organoboron and organogallium complexing agents, said -ate complex being of the types $M[BR_3(anion)]$, $M[BR_n(OR')_{3-n}(anion)]$ and $M[GaR_3(anion)]$, $M[GaR_n(OR')_{3-n}(anion)]$. Since, by virtue of said -ate complex formation, the reaction products of the hydrides remain in solution, upon completion of the reaction according to the invention the metal or alloy powder may be recovered in the pure state with particular advantage by way of a simple filtration from the clear organic solution. In the course of the reaction according to the invention, M-halides, as a rule, do not form such -ate complexes; however, in many cases after the reaction they remain dissolved in the organic solvent, for example THF. This applies to, more specifically, CsF, LiCl, $MgCl_2$, LiBr, $MgBr_2$, LI, NaI and $MgI_2$. Thus, for facilitating the work-up, in the preparation according to the invention of the metal and alloy powders from the corresponding metal-halogen compounds, the selection of the cation in the hydride is governing. Said cation should be selected so that it forms a halide with the respective halogen which halide is soluble in the organic solvent. Alternatively, M-halides which are precipitated from the organic solvent upon completion of the reaction according to the invention, e.g. NaCl, may be removed from the metal or alloy powder by washing-out, e.g. with water. It is a characteristic feature of the process carried out according to the invention that the organoboron and organogallium complexing agents can be recovered after the reaction either in the free form or by de-complexing the by-products $M(anion)_x$. Reactions of $Ni(OH)_2$ with $Na(BEt_3H)$ in THF result in the formation of $Na(BEt_3OH)$ in solution, as is evidenced by the $^{11}B$-NMR spectrum ($^{11}B$ signal at 1 ppm). From this -ate complex present in the solution, the complex-forming agent $BEt_3$ is recovered by hydrolysis using HCl/THF in a yield of 97.6% as is evidenced by analytical gas chromatography (Example 15).

BRIEF DESCRIPTION OF THE DRAWINGS

The invention will be further described with reference to the accompanying drawings, wherein.

DETAILED DESCRIPTION OF THE INVENTION

Figure 1:
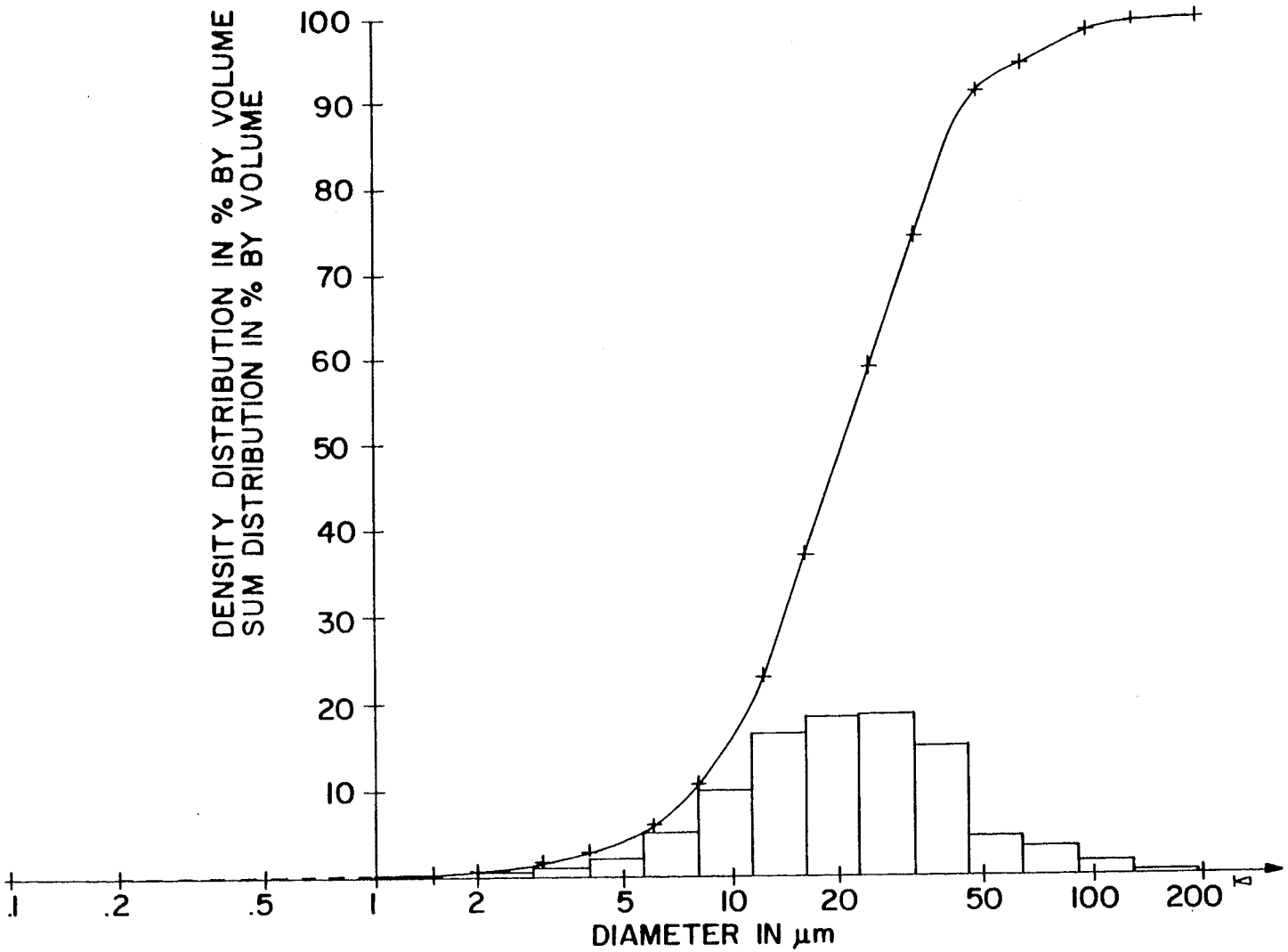
FIGS. 1 and 2 show particle size distributions resulting from different reaction conditions in accordance with the present invention.
Figure 2:
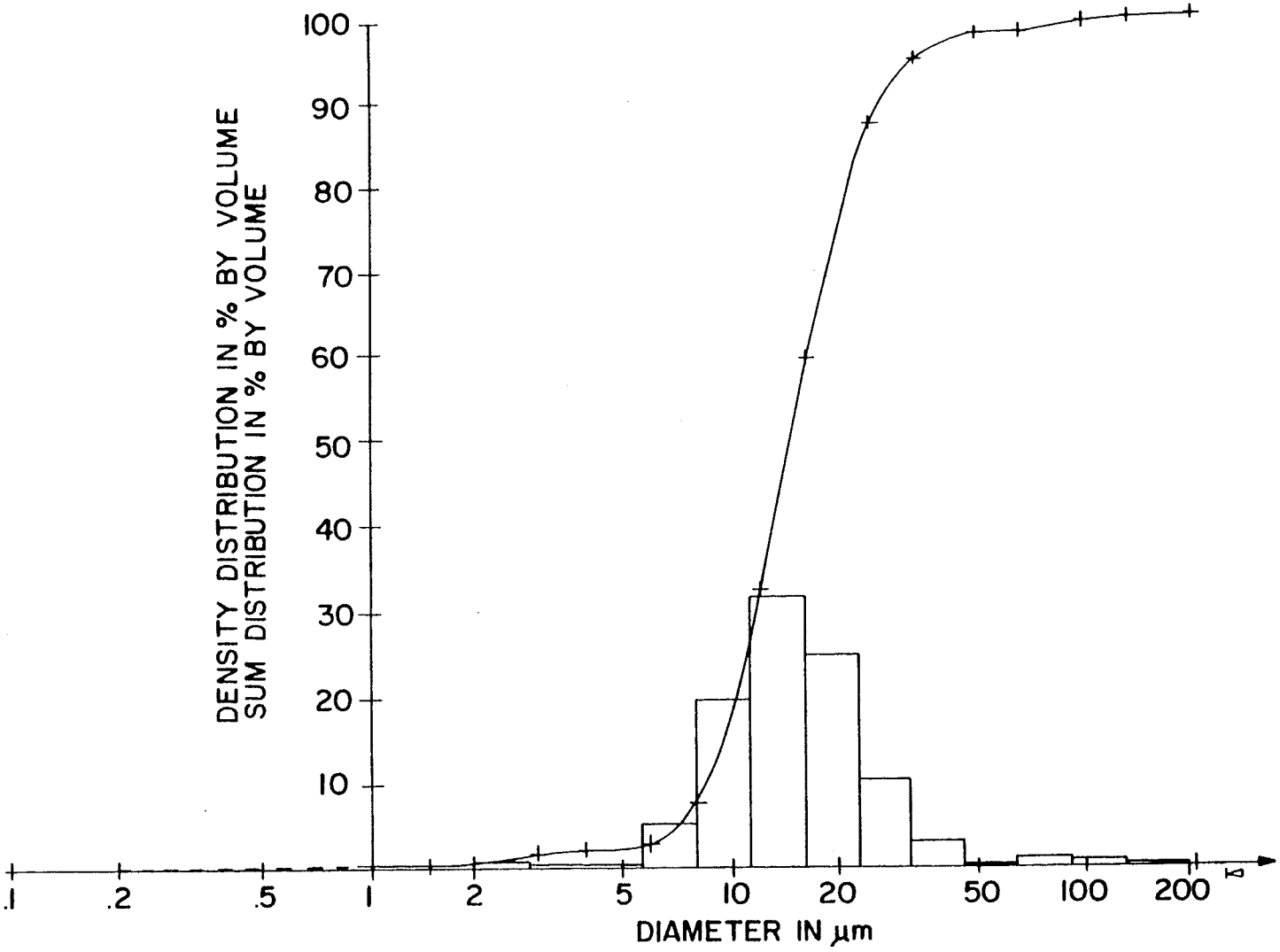

According to the invention there are obtained powder metals having a particle size of 0.01 μm (Example 11) up to 200 μm (Table 2, No. 46). The particle size distribution may be controlled via the reaction parameters. Upon a given combination of starting materials and solvent, the metal particles obtained according to the invention are the finer, the lower the reaction temperature is. Thus, the reaction of $PtCl_2$ with $Li(BEt_3H)$ in THF at 80° C. (Table 2, No. 46) provides a platinum powder which has a relatively wide particle size distribution of from 5 to 100 μm (see FIG. 1). The same reaction at 0° C. (Table 2, No. 45) provides a platinum powder which has a substantially narrower particle size distribution and marked maximum at 15 μm (see FIG. 2).

FIGURE 2

Figure 3:
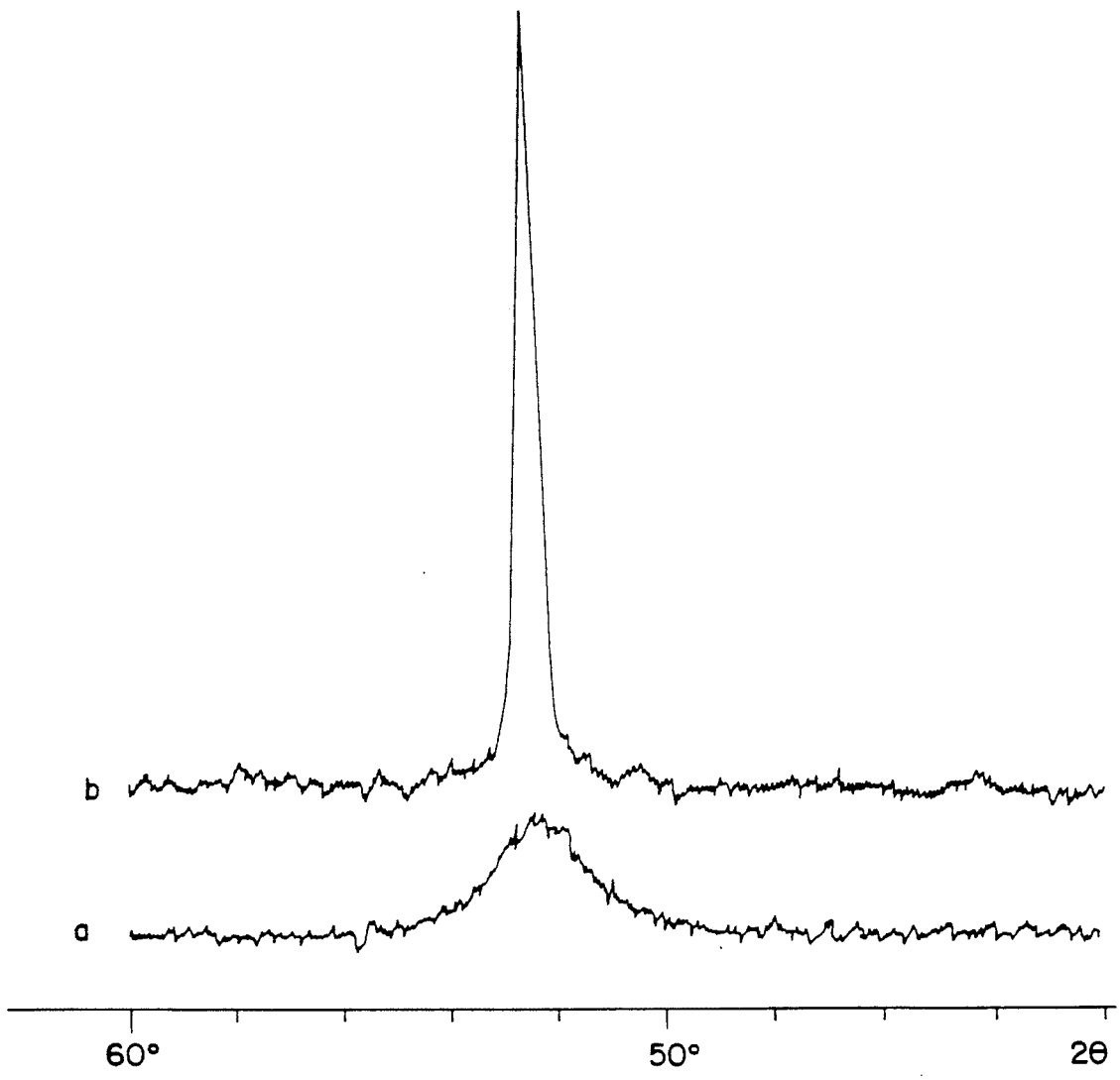
FIGS. 3, 4 and 5 are X-ray diffraction diagrams of different products in accordance with the present invention.

The metal powders prepared according to the invention are microcrystalline-to-amorphous, as is evident from the X-ray diffraction diagrams thereof. FIG. 3 shows powder X-ray diffractograms measured by means of $CoK_\alpha$-radiation of Fe powder prepared according to the invention (Table 2, No. 3) before and after a thermal treatment of the sample at 450° C. The untreated sample shows just one very broad line (FIG. 3*a*), which furnishes evidence of the presence of microcrystalline to amorphous phases (H. P. Klug, L. E. Alexander, X-ray Diffraction Procedures for Polycrystalline and Amorphous Materials, 2nd Edition, Wiley, N.Y. 1974). After 3 hours of treatment of the sample at 450° C. a sharp line, due to recrystallization, is observed at a scattering angle 2 $\theta$ of 52.4° at a lattice spacing of the planes of D=2.03 Å which is characteristic of the face-centered cubic lattice of α-iron (FIG. 3*b*).

FIGS. 3*a* and 3*b*

Figure 4:
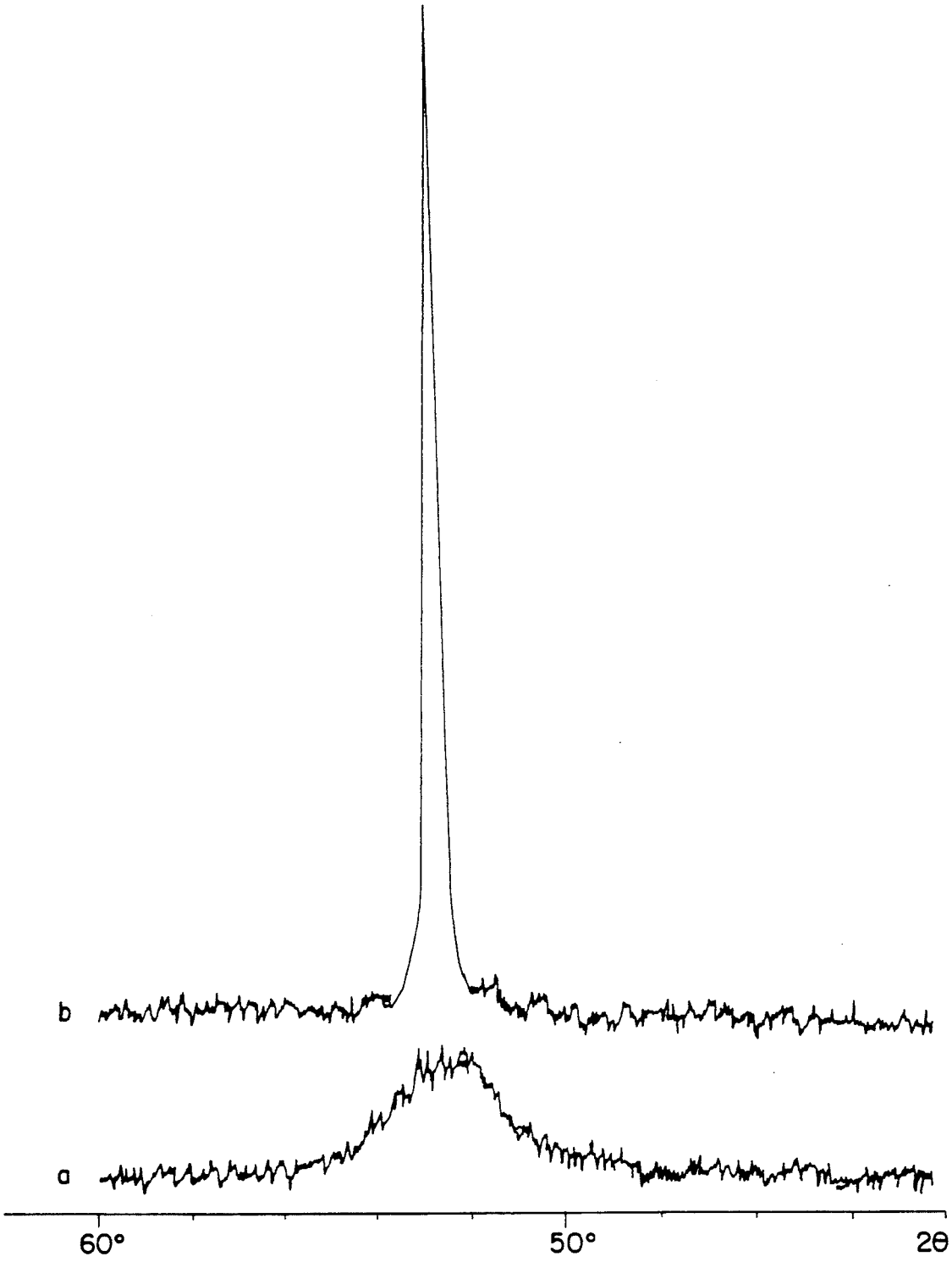

A simple co-reduction of salts of different metals or of mixed oxides in accordance with the process of the invention under mild conditions results in the formation of finely divided bi-metal and poly-metal alloys. The co-reduction of $FeSO_4$ and $CoCl_2$ with tetrahydroborate in an aqueous solution has been described by J. v. Wonterghem, St. Morup et al (Nature 1986, 322, 622). The result of said procedure - evidenced by the elemental composition and the saturation magnetization of 89 J $T^{-1}$ $kg^{-1}$ - is a Fe/Co/B alloy having the composition of $Fe_{44}Co_{19}B_{37}$. After annealing said product at 452° C., the saturation magnetization, although it increases to 166 J $T^{-1}$ $kg^{-1}$, still remains far below the value to be expected for a $Fe_{70}Co_{30}$ alloy of 240 J $T^{-1}$, which fact the authors attribute to the presence of boron in an alloyed or separate phase. In contrast thereto, the co-reduction according to the invention of $FeCl_3$ with $CoCl_2$ (molar ratio of 1:1; cf. Example Table 5, No. 6) in a THF solution with $LiH/BEt_3$ provides a boron-free powder of the $Fe_{50}Co_{50}$, as is proven by the elemental analysis. Evidence for the existence of a microcrystalline-to-amorphous Fe/Co alloy is derived from X-ray diffractograms of the powder obtained according to the invention before and after a thermal treatment (FIG. 4). Prior to the heat treatment, the diffractogram shows only a very broad diffuse line (a) which is characteristic for weakly crystalline to amorphous phases. After the heat treatment (3 hours at 450° C.) a sharp line is observed in the diffractogram (b) a scattering angle 2 $\theta$ of 52.7° at a lattice spacing of the planes of D=2.02 Å which is characteristic of a crystallized Fe/Co alloy.

FIGURE 4

Figure 5:
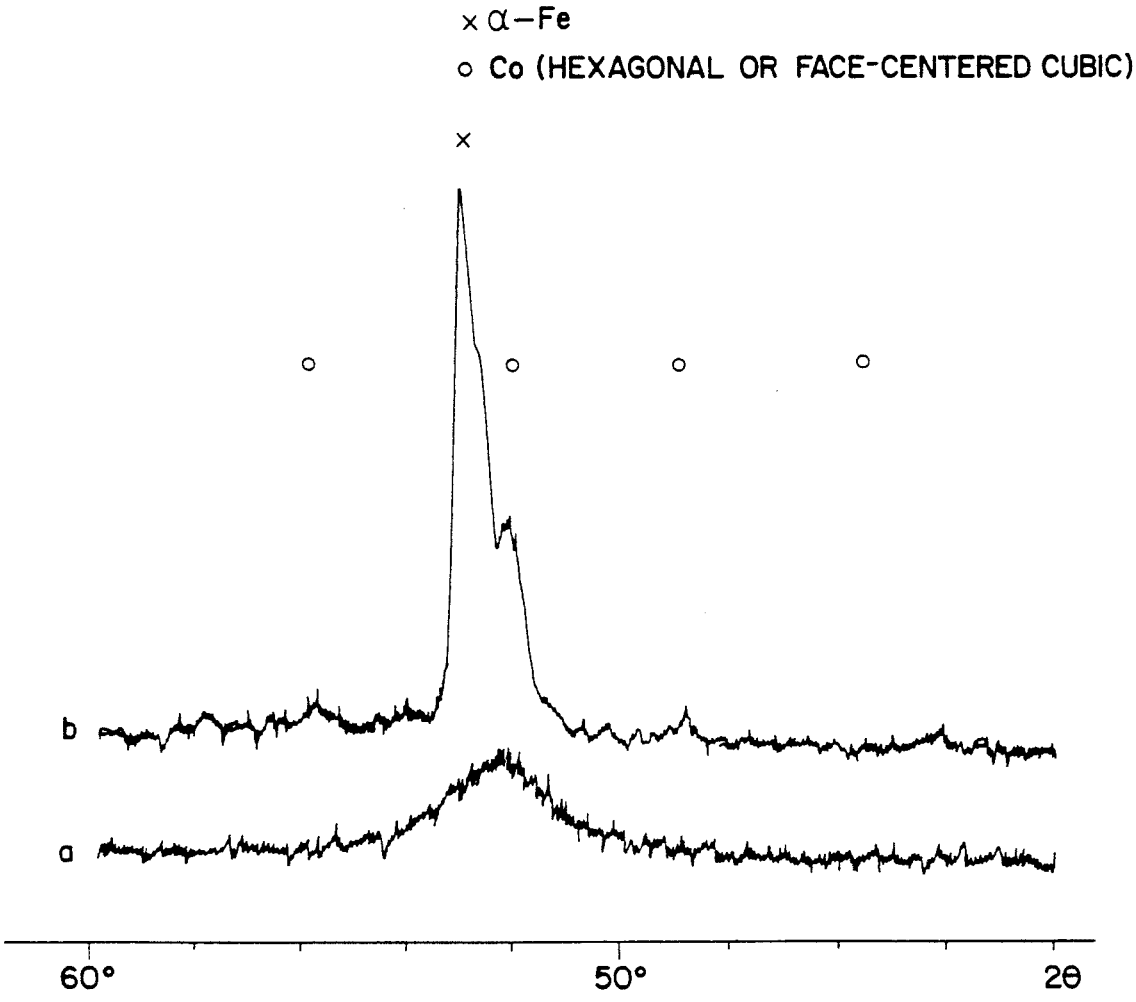

To furnish evidence of that the alloy formation already takes place in the course of the reduction process according to the invention and is by no means induced afterwards by way of the heat treatment, a 1:1 blend of amorphous Fe and Co powders was measured before and after the heat treatment effected at 450° C. (FIG. 5). The untreated blend again exhibits a diffuse line (a). After 3 hours at 450° C., the pattern develops into the superposition of two sets of lines (b) for bodycentered cubic Fe (x) and hexagonal or face-centered cubic Co (o). The comparison of the FIGS. 4 and 5 furnishes evidence of the a microcrystalline-to-amorphous alloy is formed upon the co-reduction according to the invention, which alloy re-crystallizes only upon heat treatment.

FIGURE 5

According to the invention, one-phase two- and multi-component systems in a microcrystalline to amorphous form may be produced by freely combining the salts of main group and subgroup elements, non-ferrous metals and/or noble metals. It is also possible according to the invention with a particular advantage by reducing or co-reducing metal salts and/or metal compounds or salt mixtures coated on support materials as far as these will not react with hydroethylborates (e.g. $Al_2O_3$, $SiO_2$ or organic polymers) to produce shell-shaped amorphous metals and/or alloys on supports (Example 14). Amorphous alloys in the pure or supported states are of great technical interest as catalysts.

With a particular advantage there may be obtained according to the invention under certain conditions metals and/or alloys in the form of a colloidal solution in organic solvents without the addition of a protective colloid. The reaction of the salts of non-ferrous metals or noble metals (individually or as mixtures) with the tetraalkylammonium triorgano hydroborates as accessible according to the German Patent Application P 39 01 027.9 at room temperature in THF results in the formation of stable colloidal solutions of the metals which are red when looked through. If the metal salts are employed in the form of donor complexes, then according to the invention the colloidal metals are preparable also with alkali metal or alkaline earth metal triorgano hydroborates in THF or in hydrocarbons (cf. Table 6, Nos. 15, 16, 17).

The invention is further illustrated by way of the following Examples.

TABLE 1

| | Reduction of Metal Salts or Metal Compounds | | | | | | | | | |
|---|---|---|---|---|---|---|---|---|---|---|
| | Starting Materials | | | | Reaction Conditions | | Products | | | |
| No. | Metal Salt | (mmoles) | Reducing Agent | (mmoles) | t (h) | T (°C.) | Amount Recovered (g) | Metal Content (%) | Boron Content (%) | Specific BET-Surface Area ($m^2/g$) |
| 1 | $Fe(OEt)_2$ | 12.0 | $NaBEt_3H$ | 30 | 16 | 67 | 0,6 | 96,8 | 0,16 | 62,2 |
| 2 | $CoO^+$ | 40.0 | $NaBEt_3H^{++}$ | 120 | 16 | 130 | 2,40 | 98,1 | — | 79.2 |
| 3 | $Co(OH)_2$ | 20,0 | $NaBEt_3H$ | 41 | 2 | 23 | 1,20 | 94,5 | 0,40 | 46,8 |
| 4 | $Co(OH)_2$ | 20.0 | $NaBEt_3H$ | 50 | 16 | 67 | 1,09 | 93.5 | 1,09 | 49,8 |
| 5 | $Co(OEt)_2$ | 18.6 | $NaBEt_3H$ | 47 | 16 | 67 | 1,16 | 93,5 | 0,82 | 33,2 |
| 6 | $Co(CN)_2$ | 20,0 | $NaBEt_3H$ | 100 | 16 | 67 | 1,22 | 96,5 | 0,20 | 52,1 |
| 7 | $NiO^+$ | 40,0 | $NaBEt_3H^{++}$ | 120 | 16 | 130 | 2,46 | 94,1 | 0,0 | 6,5 |
| 8 | $Ni(OH)_2$ | 20,0 | $NaBEt_3H$ | 41 | 2 | 23 | 1,15 | 94,7 | 0,13 | 29,7 |
| 9 | $Ni(OH)_2$ | 20.0 | $NaBEt_3H$ | 50 | 16 | 67 | 1,13 | 93,3 | 0,89 | 35,7 |
| 10 | $Ni(OEt)_2$ | 16,1 | $NaBEt_3H$ | 40 | 16 | 67 | 0,96 | 91.4 | 0,58 | 12.5 |
| 11 | $Ni(CN)_2$ | 18,0 | $NaBEt_3H$ | 50 | 16 | 67 | 1,17 | 89,2 | 0,63 | 53,6 |
| 12 | $CuO^+$ | 40.0 | $NaBEt_3H^{++}$ | 120 | 16 | 130 | 2,37 | 93,8 | 0,18 | 8,6 |
| 13 | CuCN | 21.3 | $NaBEt_3H$ | 26 | 2 | 23 | 1,28 | 98,7 | 0,09 | 18,6 |
| 14 | CuCN | 20.0 | $NaBEt_3H$ | 30 | 16 | 67 | 1.30 | 94,7 | 0,0 | 8,9 |
| 15 | CuCN | 47,5 | $LiBEt_3H$ | 48 | 2 | 23 | 2.83 | 97,3 | 0,0 | 5,1 |
| 16 | CuSCN | 3.5 | $NaBEt_3H$ | 4 | 2 | 23 | 0,23 | 96,1 | 0,0 | — |
| 17 | CuSCN | 20.0 | $NaBEt_3H$ | 30 | 16 | 67 | 1,24 | 95.0 | 0,23 | 2.6 |
| 18 | $PdO^+$ | 12.6 | $NaBEt_3H^{++}$ | 120 | 16 | 130 | 2,03 | 95,4 | 0,24 | 14.0 |
| 19 | $Pd(CN)_2$ | 10.0 | $NaBEt_3H$ | 22 | 2 | 23 | 1,06 | 86,6 | 1,57 | 27,6 |
| 20 | $Pd(CN)_2$ | 10,2 | $NaBEt_3H$ | 31 | 16 | 67 | 1,06 | 95.5 | 1,38 | 12,1 |
| 21 | $Ag_2O$ | 20 | $NaBEt_3H^{++}$ | 60 | 16 | 20 | 4,19 | 97,7 | 0,10 | 1,8 |
| 22 | AgCN | 10 | $Ca(BEt_3H)_2$* | 10 | 2 | 23 | 1,10 | 89,6 | 0,20 | 2,3 |
| 23 | AgCN | 10 | $NaBEt_3H$ | 12 | 2 | 23 | 1,08 | 90,5 | 0,20 | 2,4 |
| 24 | AgCN | 10 | $NaBEt_3H$ | 12 | 16 | 67 | 1,06 | 86,2 | 0,19 | 2,6 |
| 25 | $Cd(OH)_2$ | 20 | $NaBEt_3H$ | 50 | 2 | 23 | 2,25 | 97,9 | 0.22 | — |
| 26 | $PtO_2$ | 11 | $NaBEt_3H$ | 54,9 | 4 | 20 | 2,09 | 97,5 | 0,55 | — |
| 27 | $Pt(CN)_2$ | 5,3 | $NaBEt_3H$ | 14 | 16 | 67 | 1,00 | 87,5 | 0,93 | 5,7 |
| 28 | AuCN | 4.5 | $NaBEt_3H$ | 7 | 2 | 23 | 0,87 | 97.5 | 0,0 | 3,0 |
| 29 | $Hg(CN)_2$ | 11,0 | $NaBEt_3H$ | 54 | 2 | 23 | 2,18 | 96,1 | 1,29 | — |

Solvent: THF
+Autoclave experiment under $H_2$- atmosphere
++Solvent: Toluene
*Solvent: Diglyme

Example 1

Preparation of nickel powder from $Ni(OH)_2$ with $NaBEt_3H$ in THF 5 g (41 mmoles) of $NaBEt_3H$ dissolved in THF (1 molar) are dropwise added at 23° C. with stirring and under a protective gas to a solution of 1.85 g (20 mmoles) of $Ni(OH)_2$ in 200 ml of THF in a 500 ml flask. After 2 hours the clear reaction solution is separated from the nickel powder, and the latter is washed with 200 ml of each of THF, ethanol, THF and pentane. After drying under high vacuum ($10^{-3}$ mbar), 1.15 g of metal powder are obtained (see Table 1, No. 6).

Metal content of the sample: 94.7 % of Ni

BET surface area: 29.7 $m^2/g$

Example 2

Preparation of silver powder from AgCN, $Ca(BEt_3H)_2$ in Diglyme 2.38 g (10 mmoles) of $Ca(BEt_3H)_2$ dissolved in Diglyme (1 molar) are added to 1.34 g (10 mmoles) of AgCN in a 500 ml flask under a protective gas, and Diglyme is added to give a working volume of 250 ml. The mixture is stirred at 23° C. for two hours, and the black metal powder is separated from the reaction solution. The silver powder is washed with 200 ml of each of THF, ethanol, THF and pentane and dried under high vacuum ($10^{-3}$ mbar). 1.10 g of metal powder are obtained (see Table 1, No. 17).

Metal content of the sample: 89.6% of Ag

BET surface area: 2.3 $m^2/g$

Example 3

Preparation of rhenium powder from $ReCl_3$, $LiBEt_3$in THF 3.8 g (36 mmoles) of $LiBEt_3H$ dissolved in THF (1 molar) are dropwise added at 23° C. with stirring and under a protective gas to a solution of 2.43 g (8.3 mmoles) of $ReCl_3$ in 200 ml of THF in a 500 ml flask. After 2 hours the clear reaction solution is separated from the rhenium powder, and the rhenium powder is washed with 200 ml of each of THF, ethanol, THF and pentane. After drying under high vacuum ($10^{-3}$ mbar), 1.50 g of metal powder are obtained (see Table 2, No. 36).

Metal content of the sample: 95.4%

BET surface area: 82.5 $m^2/g$

Example 4

Preparation of cobalt powder from LiH, $BEt_3$ in from $CoCl_2$ 0.5 g (63 mmoles) of LiH, 0.62 g (6.3 mmoles) of triethylborane and 250 ml of THF are added to 3.32 g (25.6 mmoles) of $CoCl_2$ under a protective gas and are refluxed with stirring for 16 hours. After cooling to room temperature, the cobalt powder is separated from the reaction solution and is washed with 200 ml of each of THF, ethanol, THF and pentane. After drying under high vacuum ($10^{-3}$ mbar). 1.30 g of metal powder are obtained (see Table 2, No. 10).

Metal content of the sample: 95.8% of Co
BET surface area: 17.2 $m^2/g$

Example 5

Preparation of tantalum powder from $TaCl_5$ with LiH, $BEt_3$ in toluene 0.48 g (60 mmoles) of LiH, 0.6 g (6 mmoles) of triethylborane and 250 ml of toulene are added to 3.57 g (10 mmoles) of $TaCl_5$ under a protective gas and are heated at 80° C. with stirring for 16 hours. After cooling to room temperature, the tantalum powder is separated from the reaction solution and is washed with three times 200 ml of toluene and once with 200 ml of pentane. After drying under high vacuum ($10^{-3}$ mbar), 3.87 g of metal powder are obtained (see Table 2, No. 34).
Metal content of the sample: 46.5% of Ta Example 6

Preparation of $Na[(Et_2GaOEt)H]$ 34.5 g (200 mmoles) of diethylethoxygallium—$Et_2$-GaOEt—were boiled under reflux in 400 ml of THF with 30.5 g (1270 mmoles) of NaH for four hours. A clear solution is obtained from which excessive NaOH is removed by filtration using a D-4 glass frit.

A 0.45M solution was obtained according to the protolysis with ethanol.

Preparation of palladium powder from $PdCl_2$ and $Na[(Et_2GaOEt)H]$ 45 ml (20.25 moles) of the $Na[(Et_2GaOEt)H]$ solution thus obtained are dropwise added at 40° C. with stirring and under a protective gas to a solution of 1.91 (10.76 mmoles) of $PdCl_2$ in 200 ml of THF in a 500 ml flask. After 2 hours the clear reaction solution is separated from the rhenium powder, and the rhenium powder is washed with two times 200 ml of $H_2O$, 200 ml of THF and 200 ml of pentane. After drying under high vacuum ($10^{-3}$ mbar), 1.2 g of metal powder are obtained (see Table 2, No. 29).

Metal content of the powder: 92.7% of Pd

TABLE 2

Reduction of Metal Halides

| | Starting Materials | | | | Reaction Conditions | | Products | | | |
|---|---|---|---|---|---|---|---|---|---|---|
| No. | Metal Salt | (mmoles) | Reducing Agent | (mmoles) | t (h) | T (°C.) | Amount Recovered (g) | Metal Content (%) | Boron Content (%) | Specific BET-Surface Area ($m^2/g$) |
| 1 | $CrCl_3$ | 7,4 | $NaBEt_3H$ | 30 | 2 | 23 | 0,38 | 93,3 | 0,3 | 186,8 |
| 2 | $MnCl_2$ | 25.4 | $LiBEt_3H$ | 75 | 1 | 23 | 0.8 | 94.07 | 0,42 | — |
| 3 | $FeCl_3$ | 71.4 | $LiBEt_3H$ | 375 | 2 | 23 | 3.70 | 97,1 | 0.36 | — |
| 4 | $FeCl_3$ | 10,0 | $NaBEt_3H$ | 35 | 2 | 23 | 0,61 | 90.1 | 0,03 | 57,1 |
| 5 | $FeCl_3$ | 10,0 | $NaBEt_3H$ | 35 | 16 | 67 | 0,51 | 81,2 | 0,20 | — |
| 6 | $CoF_2$ | 21 | $NaBEt_3H$ | 46 | 2 | 23 | 1.30 | 94.6 | 0,0 | 37,9 |
| 7 | $CoF_2$ | 19,8 | $NaBEt_3H$ | 61 | 16 | 67 | 1,10 | 96.9 | 0,0 | 16,2 |
| 8 | $CoCl_2$ | 10.0 | $NaBEt_3H$ | 25 | 2 | 23 | 0,55 | 96,7 | 0,22 | 33.5 |
| 9 | $CoCl_2$ | 14,0 | $NaBEt_3H$ | 35 | 16 | 67 | 0,83 | 95.1 | 0,0 | 28.1 |
| 10 | $CoCl_2$ | 25.6 | LiH + 10% $BEt_3$ | 63 | 16 | 67 | 1,30 | 95.8 | 0.0 | 17,2 |
| 11 | $CoBr_2$ | 23 | $LiBEt_3H$ | 60 | 2 | 23 | 0.80 | 86.68 | 0.0 | 16.0 |
| 12 | $NiF_2$ | 21 | $NaBEt_3H$ | 46 | 2 | 23 | 1,56 | 71.3 | 0,0 | 29,9 |
| 13 | $NiF_2$ | 28 | $NaBEt_3H$ | 85 | 16 | 67 | 1.64 | 93.9 | 0.0 | 53,1 |
| 14 | $NiCl_2$ | 11 | $NaBEt_3H$ | 35 | 2 | 23 | 0.68 | 92.9 | 0.17 | — |
| 15 | $NiCl_2$ | 14 | $NaBEt_3H$ | 42 | 16 | 67 | 0.79 | 96.9 | 0.0 | 46.7 |
| 16 | $CuF_2$ | 16.1 | $NaBEt_3H$ | 40 | 2 | 23 | 1.01 | 97.6 | 0,3 | 7,0 |
| 17 | $CuCl_2$ | 20.7 | $LiBEt_3H$ | 60 | 2 | 23 | 1,24 | 97,3 | 0,0 | 17.8 |
| 18 | $CuBr_2$ | 18,5 | $LiBEt_3H$ | 56 | 2 | 23 | 1,18 | 94.9 | 0.0 | 2,3 |
| 19 | $CuCl_2$ | 17,5 | $Na(Et_2BOMe)H$ | 40 | 2 | 23 | 1,13 | 94,7 | 0,1 | 5,6 |
| 20 | $ZnCl_2$ | 20 | $LiBEt_3H$ | 50 | 12 | 67 | 1.30 | 97.8 | 0,0 | — |
| 21 | $RuCl_3$ | 11 | $NaBEt_3H$ | 37 | 16 | 67 | 1,15 | 95,2 | 0.52 | 98,0 |
| 22 | $RuCl_3$ | 10 | $LiBEt_3H$ | 35 | 2 | 23 | 0.75 | 90,7 | 0,0 | 22.4 |
| 23 | $RhCl_3.3H_2O$ | 10 | $NaBEt_3H$ | 65 | 2 | 23 | 1.03 | 98.1 | 0.10 | 32,5 |
| 24 | $RhCl_3$ | 10 | $NaBEt_3H$ | 33 | 2 | 23 | 1.04 | 75.9 | 0,14 | — |
| 25 | $RhCl_3$ | 10 | $NaBEt_3H$ | 36 | 16 | 67 | 1.05 | 94.7 | 0,37 | 64,6 |
| 26 | $RhCl_3$ | 14,2 | $LiBEt_3H$ | 50 | 2 | 23 | 1.46 | 96,1 | 0,66 | 29,6 |
| 27 | $PdCl_2$ | 10 | $NaBEt_3H$ | 22 | 2 | 23 | 1,00 | 96,2 | 0,18 | 7,5 |
| 28 | $PdCl_2$ | 10 | $NaBEt_3H$ | 22 | 16 | 67 | 0,91 | 98.0 | 0,29 | 9,6 |
| 29 | $PdCl_2$ | 10,8 | $Na(GaEt_2OEt)H$ | 20 | 2 | 40 | 1,20 | 92,7 | — | — |
| 30 | AgF | 10 | $NaB(OMe)_3H$ | 6 | 2 | 23 | 1,05 | 94,1 | 0,05 | — |
| 31 | AgF | 11 | $NaBEt_3H$ | 12 | 2 | 23 | 1,07 | 96,9 | 0,0 | 0,2 |
| 32 | AgI | 4,8 | $NaBEt_3H$ | 5 | 2 | 23 | 0,45 | 95,3 | 0,02 | — |
| 33 | $CdCl_2$ | 11,3 | $LiBEt_3H$ | 28,3 | 2 | 23 | 1,16 | 99,46 | 0,0 | — |
| 34 | $TaCl_5$* | 10,0 | LiH + 10% $BEt_3$ | 60 | 16 | 80 | 3,87 | 46,5 | 0,0 | — |
| 35 | $ReCl_3$ | 3,0 | $NaBEt_3H$ | 15 | 2 | 23 | 0,51 | 91,69 | 0,0 | — |
| 36 | $ReCl_3$ | 8,3 | $LiBEt_3H$ | 36 | 2 | 23 | 1,50 | 95,4 | 0,0 | 82,5 |
| 37 | $OsCl_3$ | 5,0 | $NaBEt_3H$ | 20 | 2 | 23 | 0,86 | 95,8 | 0,0 | 73,7 |
| 38 | $IrCl_3.4H_2O$ | 10,0 | $NaBEt_3H$ | 70 | 2 | 23 | 2,44 | 77,1 | 0,16 | — |
| 39 | $IrCl_3$ | 10,0 | $NaBEt_3H$ | 33 | 2 | 23 | 1,94 | 95,7 | 0,24 | 22,7 |
| 40 | $IrCl_3$ | 10,0 | $NaBEt_3H$ | 35 | 16 | 67 | 2,00 | 94.9 | 0,02 | 42,3 |
| 41 | $IrCl_3$ | 10,0 | $KBPr_3H$ | 35 | 16 | 67 | 1,95 | 94.7 | 0,08 | 33,6 |
| 42 | $PtCl_2$ | 10,0 | $NaBEt_3H$ | 22 | 2 | 23 | 1.85 | 98,2 | 0,21 | 15,9 |
| 43 | $PtCl_2$ | 10,0 | $NaBEt_3H$ | 25 | 16 | 67 | 1.97 | 95.9 | 0,34 | 16,2 |
| 44 | $PtCl_2$ | 15,0 | $LiBEt_3H$ | 40 | 2 | 23 | 2.89 | 99.2 | 0,0 | — |
| 45 | $PtCl_2$ | 15,0 | $LiBEt_3H$ | 40 | 4 | 0 | 2.83 | 99.0 | 0.0 | — |
| 46 | $PtCl_2$ | 15.0 | $LiBEt_3H$ | 40 | 12 | 67 | 2.89 | 99.03 | 0,0 | — |
| 47 | $PtCl_2$ | 10,0 | LiH + 10% $GaEt_2OEt$ | 30 | 12 | 67 | 1.92 | 99.1 | — | — |
| 48 | $PtCl_2$ | 10.0 | LiH + 10% $BEt_3$ | 30 | 5 | 67 | 1.93 | 98.8 | 0.0 | — |
| 49 | $SnCl_2$ | 10.4 | $LiBEt_3H$ | 31 | 2 | 23 | 1,04 | 96.7 | 0,0 | — |

TABLE 2-continued

| | Reduction of Metal Halides | | | | | | | | | |
|---|---|---|---|---|---|---|---|---|---|---|
| | Starting Materials | | | | Reaction Conditions | | Products | | | |
| No. | Metal Salt | (mmoles) | Reducing Agent | (mmoles) | t (h) | T (°C.) | Amount Recovered (g) | Metal Content (%) | Boron Content (%) | Specific BET-Surface Area ($m^2/g$) |
| 50 | $SnBr_2$ | 10.3 | $LiBEt_3H$ | 31 | 2 | 23 | 0,95 | 87.1 | 0.0 | — |

Solvent: THF
*Solvent: Toluene

Example 7

Preparation of rhodium powder from $RhCl_3$, $NBu_4$($BEt_3H$) in THF 11.6 g (34 mmoles) of $NBu_4(BEt_3H)$ dissolved in THF (0.5 molar) are dropwise added at 23° C. with stirring and under a protective gas to a solution of 2.15 g (10.3 mmoles) of $RhCl_3$ in 200 ml of THF in a 500 ml flask. After eight hours 100 ml of water are dropwise added to the black reaction solution, and then the rhodium powder is separated from the reaction solution. The rhodium powder is washed with 200 ml of each of THF, $H_2O$, THF and pentane and dried under high vacuum ($10^{-3}$ mbar). 1.1 g of metal powder are obtained (see Table 3, No. 4).

Metal content of the sample: 90.6%

BET surface area: 58.8 $m^2/g$

TABLE 3

| | Reductions with $NBu_4(BEt_3H)$ | | | | | | | | | |
|---|---|---|---|---|---|---|---|---|---|---|
| | Starting Materials | | | Reaction Conditions | | Products | | | | |
| No. | Metal Salt | (mmoles) | $NBu_4(BEt_3H)$ (mmoles) | t (h) | T (°C.) | Amount Recovered (g) | Metal Content (%) | Boron Content (%) | Specific BET-Surface Area ($m^2/g$) |
| 1 | $FeCl_3$ | 6.3 | 22 | 1 | 40 | 0,1 | 95,3 | 0.2 | — |
| 2 | $CoCl_2$ | 11,9 | 29 | 1 | 23 | 0,39 | 93.6 | 0.0 | 10.5 |
| 3 | $RuCl_3$ | 8,6 | 30 | 8 | 23 | 0,9 | 87.9 | 1,2 | 30,0 |
| 4 | $RhCl_3$ | 10,3 | 34 | 8 | 23 | 1,1 | 90.6 | 0,5 | 58,8 |
| 5 | $PdCl_2$ | 10,0 | 25 | 8 | 40 | 1,0 | 96,9 | 1,0 | 10,8 |
| 6 | $IrCl_3$ | 6,7 | 23 | 8 | 40 | 0,96 | 96,6 | 0,0 | 8.1 |
| 7 | $PtCl_2$ | 10.0 | 25 | 8 | 40 | 1,37 | 97,9 | 0,0 | 24:1 |

Solvent: THF

Example 8

Preparation of platinum powder from $(NH_3)_2PtCl_2$, $NaBEt_3H$ in THF 3.05 g (25 mmoles) of $NaBEt_3$ H dissolved in THF (1 molar) are dropwise added at 23° C. with stirring and under a protective gas to a solution of 3.0 g (10 mmoles) of $(NH_3)_2PtCl_2$ in 200 ml of flask. After 2 hours the clear reaction solution is separated from the platinum powder, and the platinum powder is washed with 200 ml of each of THF, $H_2O$, THF and pentane. After drying under high vacuum ($10^{-3}$ mbar), 1.95 g of metal powder are obtained (see Table 4, No. 1).

Metal content of the sample: 97.1% of Pt

TABLE 4

| | Reductions of Organometal Compounds | | | | | | | | |
|---|---|---|---|---|---|---|---|---|---|
| | Starting Materials | | | | Reaction Conditions | | Products | | |
| No. | Metal Salt | (mmoles) | Reducing Agent | (mmoles) | t (h) | T (°C.) | Amount Recovered (g) | Metal Content (%) | Boron Content (%) |
| 1 | $Pt(NH_3)_2Cl_2$ | 10 | $NaBEt_3H$ | 25 | 2 | 23 | 1,95 | 97,1 | 0,32 |
| 2 | $Pt(Py)_2Cl_2$ | 2 | $LiBEt_3H$ | 5 | 2 | 23 | 0,38 | 97,1 | 0,02 |
| 3 | $Pt(Py)_4Cl_2$ | 2 | $LiBEt_3H$ | 5 | 2 | 23 | 0,38 | 97,5 | 0,01 |
| 4 | $CODPtCl_2$ | 10 | $NaBEt_3H$ | 25 | 2 | 60 | 1.96 | 97,9 | 0,58 |
| 5 | $CODPtCl_2$ | 10 | $NaBEt_3H$ | 25 | 2 | 23 | 1,06 | 96,9 | 0,16 |

Solvent: THF
Py = pyridine
COD = cyclooctadiene-1.5

Example 9

Preparation of a cobalt-platinum alloy from $PtCl_2$, $CoCl_2$, $LiBEt_3H$ in THF 9.54 g (90 mmoles) of $LiBEt_3H$ dissolved in 90 ml of THF are dropwise added with stirring and under a protective gas to a refluxed solution of 2.04 g (15.7 mmoles) of $CoCl_2$ and 4.18 g (15.7 mmoles) of $PtCl_2$ in 260 ml of THF in a 500 ml flask. After seven hours of reaction time the mixture is allowed to cool to 23° C., and the clear reaction solution is separated from the alloy powder, which is washed with 250 ml of each of THF, ethanol, THF and pentane. After drying under high vacuum ($10^{-3}$ mbar), 3.96 g of metal alloy powder are obtained (see Table 5, No. 1).

| | |
|---|---|
| Metal content of the sample: | 76.3% of Pt.<br>21.6% of Co |
| Boron content of the sample: | 0.0% |
| BET surface area: | 18.3 $m^2/g$ |
| X-ray diffractogram measured with $CoK_\alpha$-radiation and Fe-filter: | |
| Peaks of reflections 2 $\theta$ | 55.4° (47.4°) |
| Lattice spacings of planes | 1.93 Å (2.23 Å) |

Example 10

Preparation of a iron-cobalt alloy from $FeCl_3$, $CoCl_2$, $BEt_3$, LiH in THF 1.01 g (127 mmoles) of LiH, 1.25 g (12.7 mmoles) of triethylborane and 350 ml of THF are added under a protective gas to 2.97 g (22.9 mmoles) of $CoCl_2$ and 3.79 g (23.4 mmoles) of $FeCl_3$ in a 500 ml flask. The mixture is heated at 67° C. for six hours. After cooling to room temperature, the iron cobalt alloy powder is separated from the reaction solution and washed two times with 200 ml of THF each. Then the alloy powder is stirred with 150 ml of THF as well as 100 ml of ethanol until the gas evolution has ceased. The alloy powder is once more washed with 200 ml of each of THF and pentane. After drying under high vacuum ($10^{-3}$ mbar), 2.45 g of metal alloy powder are obtained (see Table 5, No. 6).

| | |
|---|---|
| Metal content of the sample: | 47.0% of Fe, 4.1% of Co |
| Boron content of the sample: | 0.0% |
| BET surface area: | 42.0 $m^2/g$ |
| X-ray diffractogram measured with $CoK_\alpha$-radiation and Fe-filter: | |
| Peaks of reflections 2 $\theta$ | 52.7° |
| lattice spacings of planes | 2.02 Å |

Example 11

Preparation of a iron-cobalt alloy from $FeCl_3$, $CoCl_2$, $LiBEt_3H$ in THF

A solution of 9.1 g (15.7 mmoles) of $FeCl_3$ and 3.1 g (24 mmoles) of $CoCl_2$ in 1.2 liters of THF is dropwise added at 23° C. with stirring and under a protective gas to 150 ml of 1.7M (255 mmoles) solution of $LiBEt_3H$ in THF. After stirring over night, the iron-cobalt alloy is separated from the clear reaction solution and is washed two times with 250 ml of THF each. Then the alloy powder is stirred with 300 ml of ethanol, followed by stirring with a mixture of 200 ml of ethanol and 200 ml of THF until the gas evolution has ceased. The alloy powder is once more washed two times with 200 ml of THF each. After drying under high vacuum ($10^{-3}$ mbar), 5.0 g of metal alloy powder are obtained (see Table 5, No. 7).

| | |
|---|---|
| Metal content of the sample: | 54.79% of Fe, 24.45% of Co |
| Boron content of the sample: | 0.0% |
| X-ray diffractogram measured with $CoK_\alpha$-radiation and Fe-filter: | |
| Peaks of reflections 2 $\theta$ | 52.5° (99.9°) |
| Lattice spacings of planes | 2.02 Å (1.17 Å) |

Particle size determined by raster electron microscopy and X-ray diffractometry: 0.01° to 0.1° μm.

TABLE 5

Co-Reductions for the Preparation of Alloys

| No. | Starting Materials: Metal Salt | (mmoles) | Reducing Agent | (mmoles) | Reaction Conditions: t (h) | T (°C.) | Products: Amount Recovered (g) | Metal Content (%) | Boron Content (%) | Specific BET-Surface Area ($m^2/g$) | DIF[a]: 2 $\theta$[b] | D[c] (Å) | Notes |
|---|---|---|---|---|---|---|---|---|---|---|---|---|---|
| 1 | $FeCl_3$ | 56 | $LiBEt_3H$ | 250 | 5 | 23 | 4,8 | Fe: 64,5 | 0,69 | — | 52,7° | 2,02 | one-phase |
| | $CoCl_2$ | 27 | | | | | | Co: 31,6 | | | | | |
| 2 | $FeCl_3$ | 27 | $LiBEt_3H$ | 100 | 2 | 23 | 1,6 | Fe: 83,8 | 0,43 | — | — | — | — |
| | $CoCl_2$ | 3 | | | | | | Co: 10,6 | | | | | |
| 3 | $FeCl_3$ | 56,1 | $LiBEt_3H$ | 255 | 5 | 23 | 5,0 | Fe: 54,8 | 0,0 | — | 52,5° | 2,02 | — |
| | $CoCl_2$ | 23,9 | | | | | | Co: 24,5 | | | 99,9° | 1,17 | |
| 4 | $Fe_2CoO_4$* | 21,6 | $NaBEt_3H$ | 196 | 16 | 120 | 3,8 | Fe: 61,1 | 0,45 | — | 52,5° | 2,02 | one-phase |
| | | | | | | | | Co: 30,3 | | | | | |
| 5 | $FeCl_3$ | 23,4 | LiH + | 127 | 6 | 67 | 2,45 | Fe: 47,0 | 0,0 | 42,0 | 52,7° | 2,02 | one-phase |
| | $CoCl_2$ | 22,9 | 10% $BEt_3$ | 13 | | | | Co: 47,1 | | | | | micro-crystalline |
| 6 | $Co(OH)_2$ | 20 | $NaBEt_3H$ | 100 | 7 | 67 | 2,35 | Co: 48,3 | 0,25 | — | 51,7° | 2,05 | one-phase |
| | $Ni(OH)_2$ | 20 | | | | | | Ni: 45,9 | | | | | micro-crystalline |
| 7 | $Co(CN)_2$ | 22,5 | $NaBEt_3H$ | 110 | 7 | 67 | 3,0 | Co: 42,5 | 0,08 | — | — | — | — |
| | $Ni(CN)_2$ | 21,7 | | | | | | Ni: 40,3 | | | | | |
| 8 | $CoF_2$ | 21,1 | $NaBEt_3H$ | 110 | 7 | 67 | 2,61 | Co: 46,6 | 0,11 | — | 51,9° | 2,05 | one-phase |
| | $NiF_2$ | 22,9 | | | | | | Ni: 48,9 | | | | | micro-crystalline |
| 9 | $CoCl_2$ | 15,7 | $LiBEt_3H$ | 90 | 7 | 67 | 3,96 | Co: 21,6 | 0,0 | 18,3 | 55,4° | 1,93 | one-phase |
| | $PtCl_3$ | 15,7 | | | | | | Pt: 76,3 | | | 47,4° | 2,23 | |
| 10 | $RhCl_3$ | 10 | $LiBEt_3H$ | 60 | 5 | 67 | 2,49 | Rh: 26,5 | 0,04 | — | 40,2° | 2,24 | one-phase |
| | $PtCl_2$ | 10 | | | | | | Pt: 65,5 | | | 46,3° | 1,96 | |
| 11 | $RhCl_3$ | 10 | $LiBEt_3H$ | 70 | 5 | 67 | 3,00 | Rh: 33,5 | 0,15 | — | 42,3° | 2,14 | one-phase + traces of $IrCl_3$ |
| | $IrCl_3$ | 10 | | | | | | Ir: 62,5 | | | | | |
| 12 | $PdCl_2$ | 10 | $LiBEt_3H$ | 50 | 5 | 67 | 3,02 | Pd: 33,6 | 0,04 | — | 40,1° | 2,25 | one-phase |
| | $PtCl_2$ | 10 | | | | | | Pt: 63,4 | | | 46,3° | 1,96 | |
| 13 | $PtCl_2$ | 10 | $NaBEt_3H$ | 75 | 12 | 67 | 3,80 | Pt: 50,2 | 0,15 | 33,3 | 40,0° | 2,25 | one-phase |
| | $IrCl_3$ | 10 | | | | | | Ir: 48,7 | | | 46,5° | 1,95 | micro-crystalline |
| 14 | $CuCl_2$ | 21,4 | $LiBEt_3H$ | 100 | 4 | 67 | 2,56 | Cu: 49,6 | 0,0 | 2,9 | | | $Cu_6Sn_5$ + Cu + Sn |
| | $SnCl_2$ | 16,4 | | | | | | Sn: 47,6 | | | | | |
| 15 | $FeCl_3$ | 20 | $LiBEt_3H$ | 245 | 1,5 | 23 | 3,65 | Fe: 30,18 | 0,0 | — | | | one-phase |
| | $CoCl_2$ | 20 | | | | | | Co: 31,45 | | | | | micro- |

TABLE 5-continued

| | Starting Materials | | Reducing | | Reaction Conditions | | Products | | | Specific BET-Surface | DIF[a] | | |
|---|---|---|---|---|---|---|---|---|---|---|---|---|---|
| | | | | | | | Amount Re- | Metal | Boron Con- | Area | | D[c] | |
| No. | Metal Salt | (mmoles) | Agent | (mmoles) | t (h) | T (°C.) | covered (g) | Content (%) | tent (%) | ($m^2/g$) | 2 θ[b] | (Å) | Notes |
| | $NiCl_2$ | 20 | | | | | | Ni: 30,96 | | | | | crystalline |

Co-Reductions for the Preparation of Alloys

Solvent: 350 ml of THF
[a]X-ray diffractogram, measured with $CoK_\alpha$-radiation using a Fe filter
[b]Maxima of reflection
[c]Lattice spacing of the planes
*autoclave experiment under $H_2$-atmosphere

Example 12

Preparation of a colloidal chromium solution using $NBu_4(BEt_3H)$ in THF 1.58 g (10 mmoles) of $CrCl_3$ and 11.25 g (33 mmoles) of $NBu_4(BEt_3H)$ dissolved in THF are dissolved in another 300 ml of THF at 23° C. with stirring and under a protective gas. A colloidal chromium solution is obtained (see Table 6, No. 2).

Example 13

Preparation of a colloidal platinum solution from $Pt(Py)_4Cl_2$ and $KBEt_3H$ in toluene (Py=pyridine)

0.583 g (1 mmole) of $Pt(Py)_4Cl_2$ and 0.28 g (2 mmoles) of $KBEt_3H$ are dissolved in 300 ml of toluene at −20° C. with stirring and under a protective gas. A colloidal platinum solution of dark-read appearance in transparent light is obtained (see Table 6, No. 17).

TABLE 6

Preparation of Colloidal Metal Solutions

| | Starting Materials | | $NBu_4(BEt_3H)$ | Reaction Conditions t | T | | |
|---|---|---|---|---|---|---|---|
| No. | Metal Salt | (mmoles) | (mmoles) | (min) | (°C.) | Solvent | (ml) |
| 1 | $MnCl_2$ | 10 | 25 | 20 | 23 | THF | 300 |
| 2 | $CrCl_3$ | 10 | 33 | 20 | 23 | THF | 300 |
| 3 | $FeCl_3$ | 10 | 35 | 20 | 23 | THF | 300 |
| 4 | $CoF_2$ | 10 | 25 | 20 | 23 | THF | 300 |
| 5 | $CoCl_2$ | 10 | 25 | 20 | 23 | THF | 300 |
| 6 | $NiF_2$ | 10 | 25 | 20 | 23 | THF | 300 |
| 7 | $NiCl_2$ | 10 | 25 | 20 | 23 | THF | 300 |
| 8 | $RuCl_3$ | 1 | 4 | 20 | 23 | THF | 300 |
| 9 | $RhCl_3$ | 1 | 4 | 20 | 23 | THF | 300 |
| 10 | $PdCl_2$ | 1 | 3 | 20 | 23 | THF | 300 |
| 11 | $IrCl_3$ | 1 | 4 | 20 | 23 | THF | 300 |
| 12 | $ReCl_3$ | 1 | 4 | 20 | 23 | THF | 300 |
| 13 | $OsCl_3$ | 1 | 4 | 20 | 23 | THF | 300 |
| 14 | $PtCl_2$ | 1 | 3 | 20 | 23 | THF | 300 |
| 15 | $(COD)PtCl_2$ | 1 | 3 | 20 | 23 | THF | 150 |
| 16 | $Pt(Py)_4Cl_2$ | 1 | 2.0* | 300 | −20 | THF | 150 |
| 17 | $Pt(Py)_4Cl_2$ | 1 | 2.0* | 300 | −20 | Toluene | 300 |
| 18 | $CoCl_2/FeCl_3$ | 1/1 | 6 | 20 | 23 | THF | 300 |

*$KBEt_3H$
Py = pyridine
COD = cyclooctadiene-1,5

Example 14

Preparation of a FE/Co alloy on an $Al_2O_3$ support 11.5 g (70.89 mmoles) of $FeCl_3$ and 2.3 g (17.7 moles) of $CoCl_2$ are dissolved in 1 liter of THF. In a wide-necked reagent bottle with a conical shoulder 50 g of $Al_2O_3$ (SAS 350 pellets, Rhône Poulenc) are impregnated over night in 335 ml of the above-prepared $FeCl_3/CoCl_2$ solution in THF, whereupon the green solution becomes almost completely discolored. The solvent is removed, and the support is dried under high vacuum ($10^{-3}$ mbar) for three hours. The impregnation is repeated with another 335 ml of $FeCl_3/CoCl_2$ solution, whereby an intensely colored yellow solution is obtained. The solution is removed, and the support is again dried under high vacuum ($10^{-3}$ mbar) for three hours. The impregnation is once more carried out with 330 ml $FeCl_3/CoCl_2$ solution overnight, whereupon no further change in color occurs. The solution is removedm and the $Al_2O_3$ pellets are treated with 63.6 g (600 mmoles) of $LiBEt_3H$ in 400 ml of THF at 23° C. for 16 hours, whereby the color of the pellets turns to black. The reaction solution is e removed, and the pellets are washed with 300 ml of each of THF, THF/ethanol(2:1), THF and dried under high vacuum ($10^{-3}$ mbar) for four hours. Obtained are $Al_2O_3$ pellets which have been provided only on the surfaces thereof with a shell-like coating of a Fe/Co alloy.

Elemental analysis: 1.13% of Fe; 0.50% of Co.

Example 15

Regeneration of the carrier $BEt_3$

To the clear reaction solution separated from the nickel powder in Example 1 there are dropwise added 11.7 ml of a 3.5M (41 mmoles) solution of HCl in THF with stirring and under a protective gas within 20 minutes, whereupon, after briefly foaming and slight generation of heat, a white precipitate (NaCl) is formed. The reaction mixture is neutralized with $Na_2CO_3$ and filtered through a D-3 glass frit. 222.5 g of a clear filtrate are obtained which, according to analysis by gas chromatography, contains 1.76% (3.92 g=40 mmoles) of $BEt_3$. Thus, 97 5% of the carrier $BEt_3$ are recovered, relative to the carrier complex initially employed.

Example 16

Regeneration of the carrier $BEt_3$

To the solution separated in Example 3 there are added 1.62 g (10 mmoles) of $FeCl_3$. Upon completion of the reaction the solution is distilled. 206 g of a clear distillate are obtained hich, according to analysis by gas chromatography, contains 1.63% (3.36 g=34.3 mmoles) of $BEt_3$. Thus, 95.2% of the carrier $BEt_3$ are recovered, relative to the carrier complex initially employed.

Example 17

Preparation of cobalt powder from CoO with $NaBEt_3H$ in toluene

In a 250 ml autoclave equipped with a stirrer, 3.0 g (40 mmoles) of CoO and 70 ml of toluene are admixed under a protective gas with 75 ml of an 1.61M $NaBEt_3H$ solution (120 mmoles in toluene) and heated in an $H_2$ atmosphere (3 bar) at 130° C. for 16 hours. After cooling to room temperature, the protective gas ($H_2$) is vented, and a black reaction mixture is discharged. The cobalt powder is separated from the supernatant clear solution and is washed with 200 ml of THF. Then the mixture is stirred with 100 ml of THF as well as 100 ml until the gas evolution has ceased, is washed two more times with 200 ml of THF each and, after 2 hours of drying under high vacuum ($10^{-3}$ mbar), 2.4 g of metal powder are obtained (see Table 1, No. 2).

Metal content of the sample: 98.1% of Co

BET surface area: 79.2 $m^2/g$

Example 18

Preparation of Silver powder from $Ag_2O$ with $NaBEt_3H$ in toluene 39 ml of a 1.55M $NaBEt_3H$ solution (60 mmoles) in toluene are dropwise added at room temperature with stirring and under a protective gas to 4.64 g (20 mmoles) of $Ag_2O$ and 31 ml of toluene in a 500 ml flask. After 16 hours the reaction solution is separated from silver powder, and the latter is washed with 200 ml of THF. Then the mixture is stirred with 100 ml of THF as well as 100 ml until the gas evolution has ceased, is washed two more times with 200 ml of THF each and, after drying under high vacuum ($10^{-3}$ mbar), 4.19 g of metal powder are obtained (see Table 1, No. 21)

Metal content of the sample: 97.7% of Ag

BET surface area: 71.8 $m^2/g$

Example 19

Preparation of nickel as a shell-shaped coating on an aluminum support from $NiCl_2 \cdot 6\ H_2O$ with $LiBEt_3H$ in THF 270 g of spherical neutral aluminum oxide are shaken in a solution of 150 g (631.3 mmoles) of $NiCl_2 \cdot 6\ H_2O$ in 500 ml of ethanol for 45 minutes, rid of the supernatant and dried under high vacuum ($10^{-3}$ mbar)at 250° C. 24 hours. After cooling, 1 liter of a 1.5M $LiBEt_3$ solution in THF is added, and after 16 hours of shaking the clear reaction solution is removed. The residue is washed with 1.5 liters of each ot THF, THF/ethanol mixture(1:1), THF and, upon drying under high vacuum ($10^{-3}$ mbar), a spherical aluminum oxide comprising 2.5% of Ni metal applied in the form of a shell. The Ni-content may be increased, while the shell structure is retained, be repeating the operation.

Example 20

Preparation of nickel-impregnated aluminum oxide support from $NiCl_2 \cdot 6\ H_2O$ with $LiBEt_3H$ in THF 270 g of spherical neutral aluminum oxide are impregnated with a solution of 200 g (841.7 mmoles) of $NiCl_2 \cdot 6\ H_2O$ in 500 ml of distilled water for 16 hours. After drying under high vacuum (250° C., 24 h), the solid is reacted with $LiBEt_3H$ in the same manner as described in Example 19. Upon work-up there is obtained a nickel-impregnated aluminum oxide having a nickel content of 4.4%. The nickel content may be increased by repeating the operation.

We claim:

1. A process for the preparation of a highly dispersed microcrystalline-to-amorphous metal and/or alloy in the form of a powder or colloid, which comprises forming a solution of a metal hydride of the 1st or 2nd main groups of the Periodic Table of the Elements (PSE) by means of a complexing agent, or with $NR''_4(BR_3H)$, $NR''_4[BR_n(OR')_{3-n}H)$, (R=$C_1$–$C_6$-alkyl, Ar-$C_1$–$C_6$-alkyl; R'=$C_1$–$C_6$-alkyl, aryl, Ar-$C_1$–$C_6$-alkyl; R''=$C_1$–$C_6$-alkyl, aryl, Ar-$C_1$–$C_6$-alkyl, tri-$C_1$ –$C_6$-alkyl; n=0, 1, 2), and reacting said solution with a metal salt in an inert organic solvent.

2. The process according to claim 1, wherein the metal salt comprises at least one salt of a metal of the Groups IVA, IB, IIB, VB, VIB, VIIB and VIIIB of PSE dissolved and/or suspended in an organic solvent and is reacted with a metal hydride of the formula $MH_x$ (x=1, 2) of the 1st or 2nd groups of PSE at from −30° C. to +150° C. in the presence of a complexing agent of the formula $BR_3$, $BR_n(OR')_{3-n}$ or $GaR_3$, $GaR_n(OR')_{3-n}$.

3. The process according to claim 1, wherein the metal salt is used in the form of a donor complex.

4. The process according to claim 1, wherein the metal salt is reacted with a metal hydride and a less-than-stoichiometric amount of the complexing agent.

5. The process according to claim 1, wherein the complexing agent is regenerated by acidification in the form of $BR_3$ or $BR_n(OR')_{3-n}$, respectively.

6. The process according to claim 1 for the preparation of metals or alloys in the form of colloidal THF solutions, wherein a salt of a non-ferrous or noble metal is reacted individually or in admixture with a tetraalkylammonium triorganohydroborate in the THF.

7. The process according to claim 1, wherein the reaction is carried out in the presence of a support material.

8. The process according to claim 1 for the preparation of a metal or alloy in the form of a colloidal solution in THF and/or a hydrocarbon, which comprises reacting a donor complex of a non-ferrous or nobel metal individually or in admixture with a tetraalkylammonium triorganohydroborate or alkali metal or alkaline earth metal hydride in the presence of a complexing agent in THF and/or a hydrocarbon.

9. The process according to claim 1, wherein the metal or alloy in the form of a colloidal solution in THF and/or a hydrocarbon is prepared in the presence of an inorganic or organic support material and/or bonded to a support.

10. The process according to claim 1, wherein a Pt powder having a particle size of from 2 to 200 μm is formed and used in the powder-metallurgical coating of glass and ceramic materials.

11. The process according to claim 1, wherein an Fe/Ni/Co alloy is formed and used in the powder-metallurgical sealing of glass materials.

* * * * *